US008864530B2

(12) United States Patent
Uno et al.

(10) Patent No.: US 8,864,530 B2
(45) Date of Patent: Oct. 21, 2014

(54) JACK WITH A SWITCH MECHANISM HAVING A MOVABLE INSULATION SEPARATOR

(75) Inventors: Yutaka Uno, Yao (JP); Koji Matsumoto, Yao (JP)

(73) Assignee: Hosiden Corporation, Yao-Shi (JP)

( * ) Notice: Subject to any disclaimer, the term of this patent is extended or adjusted under 35 U.S.C. 154(b) by 19 days.

(21) Appl. No.: 11/723,036

(22) Filed: Mar. 16, 2007

(65) Prior Publication Data

US 2007/0218773 A1 Sep. 20, 2007

(30) Foreign Application Priority Data

Mar. 17, 2006 (JP) ..... 2006-073776

(51) Int. Cl.

| | |
|---|---|
| ***H01R 24/00*** | (2011.01) |
| ***H01R 13/703*** | (2006.01) |
| ***H01R 24/58*** | (2011.01) |
| *H01R 105/00* | (2006.01) |
| *H01R 107/00* | (2006.01) |

(52) U.S. Cl.

CPC ..... *H01R 13/7032* (2013.01); *H01R 2105/00* (2013.01); *H01R 24/58* (2013.01); *H01R 2107/00* (2013.01)

USPC ..... 439/668

(58) Field of Classification Search

CPC ..... H01R 24/58; H01R 2103/00; H01R 2107/00; H01R 2105/00; H04Q 1/142

USPC ..... 439/668, 669, 188; 200/51.09

See application file for complete search history.

(56) References Cited

U.S. PATENT DOCUMENTS

| | | | | |
|---|---|---|---|---|
| 4,426,558 | A | 1/1984 | Tanaka | |
| 6,080,021 | A * | 6/2000 | Weingartner | 439/669 |
| 6,835,080 | B1 * | 12/2004 | Chang | 439/188 |
| 7,108,529 | B1 * | 9/2006 | Huang | 439/188 |
| 7,128,591 | B2 * | 10/2006 | Tsai | 439/188 |
| 2005/0095908 | A1 * | 5/2005 | Xue et al. | 439/541.5 |
| 2007/0099517 | A1 * | 5/2007 | Huang | 439/668 |

FOREIGN PATENT DOCUMENTS

| | | |
|---|---|---|
| JP | 53055694 | 5/1978 |
| JP | 58-878276 | 6/1983 |
| JP | 2131278 | 10/1990 |
| JP | 5-17964 | 3/1993 |
| JP | 2551276 | 6/1997 |
| JP | 2551276 | 10/1997 |

OTHER PUBLICATIONS

Japanese Office Action, Jan. 5, 2010, Japanese Patent Office.
European Search Report, EPO, The Netherlands, Aug. 11, 2011.

* cited by examiner

*Primary Examiner* — Amy Cohen Johnson
*Assistant Examiner* — Vladimir Imas
(74) *Attorney, Agent, or Firm* — Rankin, Hill & Clark LLP

(57) ABSTRACT

The invention relates to a jack having a switch mechanism SW of the single-butt contact type in which an ON/OFF operation is performed by insertion/extraction of a plug P. When the plug is inserted, a displacement load is applied by the separator to a middle portion in the length direction of the movable contact piece to flex the movable contact piece while setting a basal end portion of the movable contact piece as a fulcrum, whereby a tip end portion thereof is contacted with the stationary contact piece. Thereafter, the middle portion in the length direction of the movable contact piece is flexed while setting the tip end portion as a fulcrum, to apply a contact pressure on a contact. As a result, miniaturization of the jack, and reduction of the production cost can be realized.

4 Claims, 6 Drawing Sheets

JACK WITH A SWITCH MECHANISM HAVING A MOVABLE INSULATION SEPARATOR

BACKGROUND OF THE INVENTION

1. Filed of the Invention

The present invention relates to a jack which is to be used for inputting and outputting a video/audio signal in an electronic apparatus such as a portable telephone, a digital camera, or portable audio equipment, and more particularly to a jack having a switch mechanism of the single-butt contact type in which an ON/OFF operation is performed by insertion/extraction of a plug.

2. Description of the Prior Art

As a conventional art of a jack of this type, Japanese Utility Model Registration No. 2,551,276 and Japanese Utility Model Application Laying-Open No. 5-17964 disclose a jack having a switch mechanism of the single-butt contact type having a structure which is configured by: two contact pieces that are opposed to each other outside a plug insertion hole so that, when a plug is inserted, the contact pieces are not contacted with the plug; and an insulator that is projected in the plug insertion hole so that, when the plug is inserted, the insulator is pressed by the plug to be displaced, and in which, when the plug is inserted, a displacement load is applied by the insulator to a tip end portion of an inner one of the contact pieces to flex the inner contact piece while setting a basal end portion of the contact piece as a fulcrum, whereby the tip end portion is contacted with a tip end portion of the outer contact piece, and thereafter the tip end portion of the outer contact piece is pressed by the tip end portion of the inner contact piece to flex the outer contact piece while setting a basal end portion of the contact piece as a fulcrum, to apply a contact pressure on a contact. In the conventional art, therefore, a portion where the insulator serving as a jack body is incorporated into the switch mechanism is largely outward projected, and an incorporation space for the switch mechanism having a contact displacement space is ensured also in the outside of the outer contact piece. As both of the two contact pieces, plate springs which are produced by punching and bending a thin metal plate having spring characteristics, and which function as movable contact pieces are used.

SUMMARY OF THE INVENTION

The problem which is be solved by the invention is as follows. In the case where the outer contact piece is used as a stationary contact piece, the switch mechanism can be incorporated into a space which is reduced by a degree corresponding to unnecessity of the contact piece displacement space in the outside of the outer contact piece, and the outer contact piece can be produced by an economical material which is not required to have spring characteristics, and only by a punching process, whereby the component cost of the switch mechanism can be correspondingly reduced. Therefore, miniaturization of the jack, and reduction of the production cost can be realized. In the conventional art, however, the outer contact piece is flexed when it is contacted with the inner contact piece, whereby the contact pressure is applied on the contact. Therefore, the outer contact piece cannot be fixed.

In order to solve the problem of the conventional art, the jack of the invention has a switch mechanism of the single-butt contact type having a structure which is configured by: a stationary contact piece, and a movable contact piece using a plate spring of a cantilevered beam, the contact pieces being opposed to each other outside a plug insertion hole in a manner that, when a plug is inserted, the contact pieces are not contacted with the plug; and an insulator that is projected in the plug insertion hole in a manner that, when the plug is inserted, the insulator is pressed by the plug to be displaced, and in which, when the plug is inserted, a displacement load is applied by the insulator to a middle portion in a length direction of the movable contact piece to flex the movable contact piece while setting a basal end portion of the contact piece as a fulcrum, whereby a tip end portion is contacted with the stationary contact piece, and thereafter the middle portion in the length direction of the movable contact piece is flexed while setting the tip end portion as a fulcrum, to apply a contact pressure on a contact. In the two contact pieces of the switch mechanism of the single-butt contact type which is disposed in the jack, one contact piece is used as the movable contact piece, and the other contact piece is used as the stationary contact piece, so that the switching function which is identical with that of the conventional art can be performed. Therefore, the switch mechanism can be incorporated into a small space, and the component cost of the switch mechanism can be reduced. As a result, miniaturization of the jack, and reduction of the production cost can be realized.

In the invention, preferably, an insulation wall is disposed in close contact with a side of the stationary contact piece which is opposite to the movable contact piece. In the embodiment, the contact pressure due to the flexure of the movable contact piece does not escape, and can be surely applied to the contact without causing a loss.

In the invention, preferably, the insulator is bent at a position corresponding to the middle portion in the length direction of the movable contact piece, one side with respect to the bent portion overlaps with a basal end side with respect to the middle portion in the length direction of the movable contact piece, an end portion of one side is coupled to the basal end portion of the movable contact piece, and another side with respect to the bent portion is inclinedly raised with respect to a tip end side with respect to the middle portion in the length direction of the movable contact piece to be projected in the plug insertion hole while progressively increasing a projection amount as advancing in a direction of insertion of the plug, and the middle portion in the length direction of the movable contact piece is pressed by the bent portion. In the embodiment, when the plug is inserted, the insulator can surely apply the displacement load to the middle portion in the length direction of the movable contact piece.

In the invention, preferably, the insulator is pressed and displaced by a plug tip disposed in the tip end of the plug. In the embodiment, a switch circuit which is in an ON state in the case where the plug is sufficiently inserted, and in an OFF state in the other case can be configured by the switch mechanism.

DETAILED DESCRIPTION OF THE PREFERRED EMBODIMENT

Figure 1:
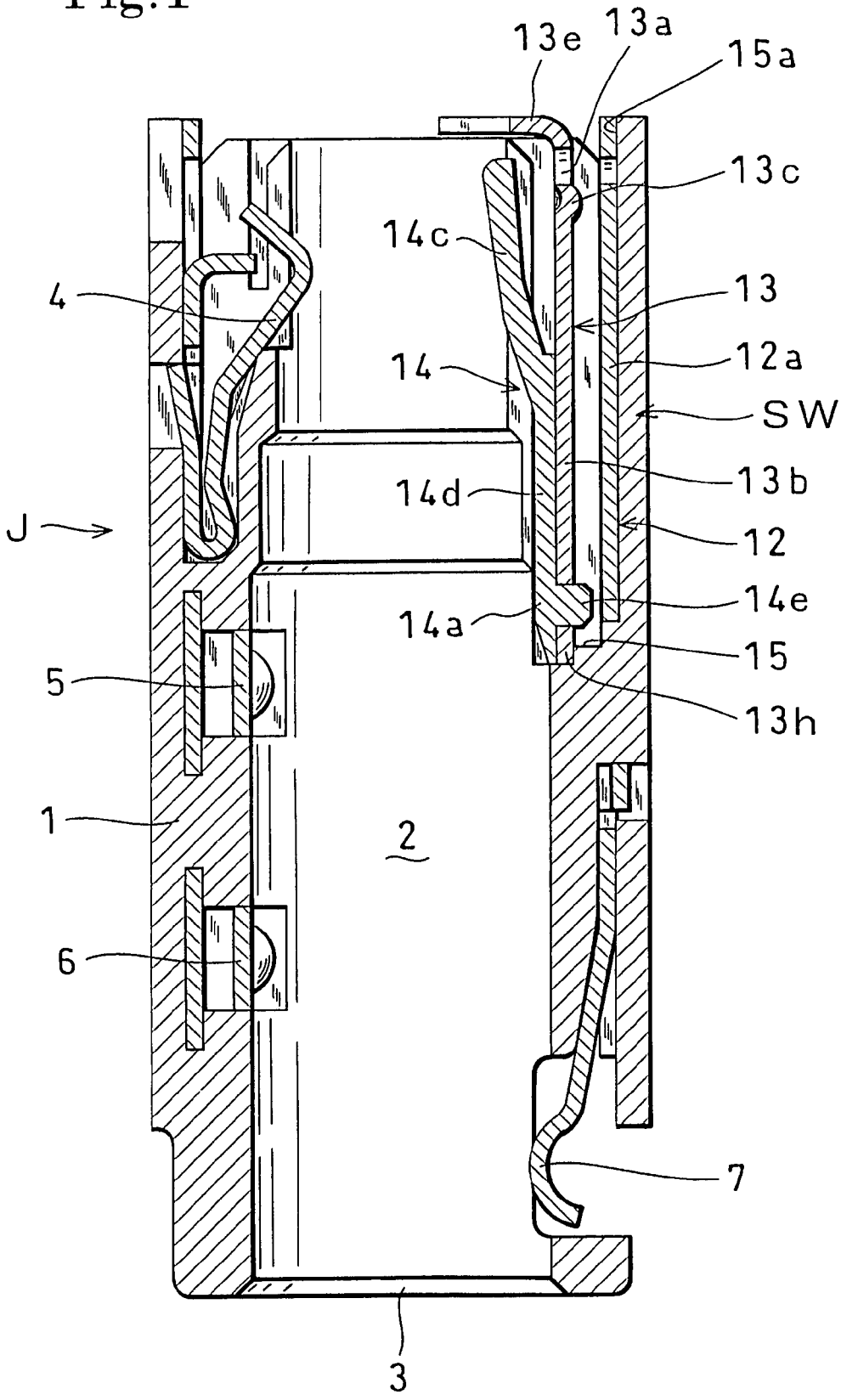
FIG. 1 is a section view of a jack which is an embodiment of the invention.

Hereinafter, an embodiment of the invention will be described with reference to the accompanying drawings. FIG. 1 shows a jack J of the embodiment of the invention. In the jack J, a plug insertion hole 2 which penetrates from one end of a body 1 to the other end is disposed in a center portion of the body 1 which is formed by an insulator having a substantially rectangular parallelepiped shape, and which serves as a jack body. A plug insertion port 3 is disposed in one end of the body 1 to communicate with the plug insertion hole 2. A tip spring contact piece 4 which is a movable contact piece using a metal plate spring, a first ring spring contact piece 5, and a second ring spring contact piece 6 are disposed on one side of the inner face (peripheral wall face of the plug insertion hole 2) of the body 1 in the sequence starting from the inner side of the plug insertion hole 2, and a sleeve spring contact piece 7 which is a movable contact piece using a metal plate spring is disposed in the vicinity of the plug insertion port 3 which is on the opposite side, whereby the jack is configured as a four-pole jack. The spring contact pieces 4 to 7 are inserted into and engaged with corresponding contact piece insertion grooves which are disposed in the body 1, respectively, to be incorporated into the body 1. Each of the spring contact pieces 4 to 7 is provided with a soldering leg portion (not shown) which is projected from the lower face of the body 1, and which is to be connected to a circuit board (not shown).

Figure 6:
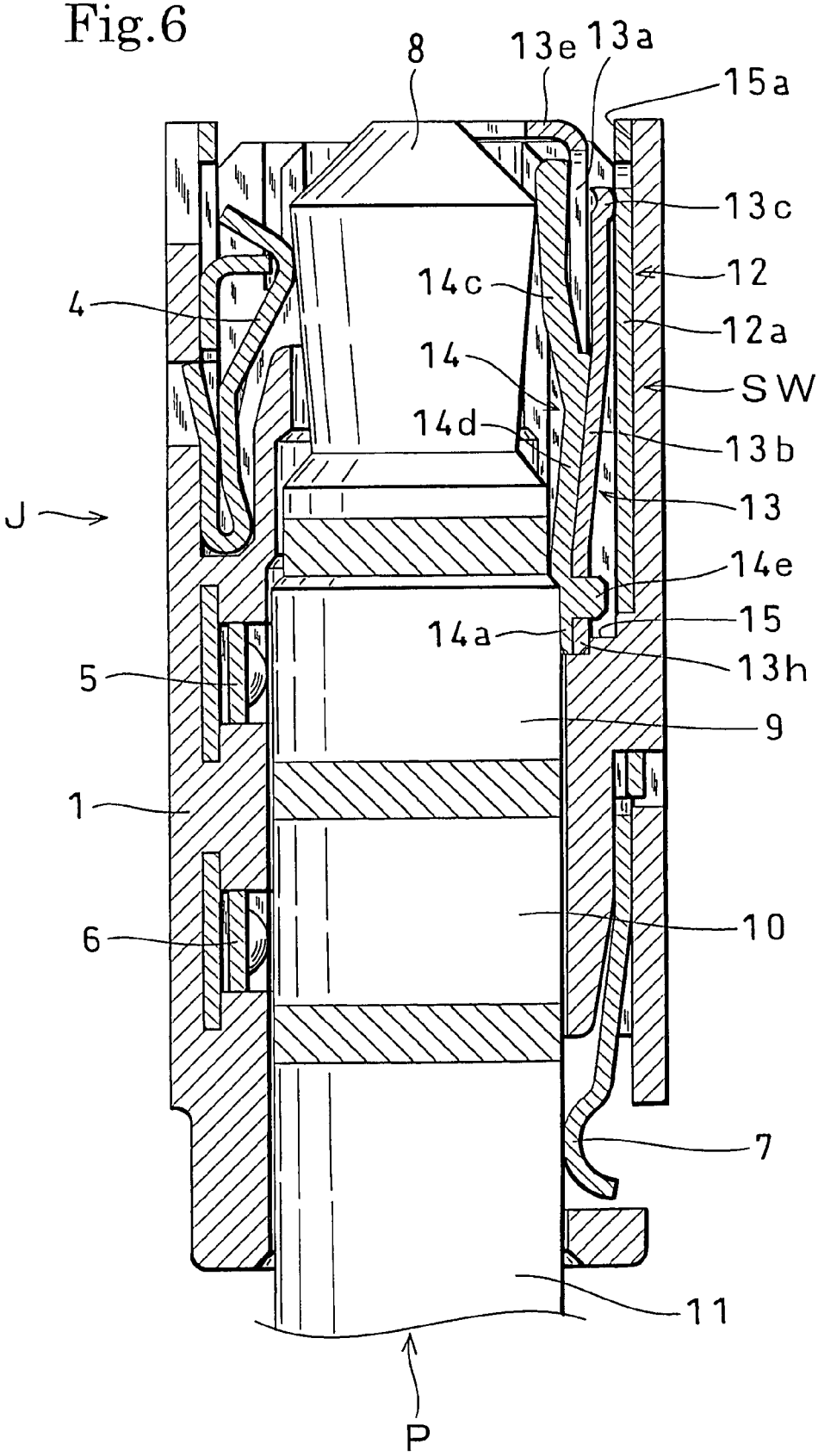
FIG. 6 is a section view of the plug jack in a state where the plug is inserted completely into the jack of FIG. 1.

FIG. 6 is a section view of the plug jack in a state where the plug P is inserted completely into the jack J of FIG. 1. The jack J cooperates with a pin-like four-pole plug P to constitute a four-pole plug jack. In the plug P, four conductors, or a plug tip 8, a first plug ring 9, a second plug ring 10, and a plug sleeve 11 are disposed in the sequence starting from the tip end are disposed, whereby a four-pole plug is configured. In the plug jack, when the plug P is sufficiently inserted from the plug insertion port 3 of the jack J into the plug insertion hole 2 (complete insertion), the plug tip 8 of the plug P is contacted with the tip spring contact piece 4 of the jack J, and similarly the first plug ring 9, second plug ring 10, and plug sleeve 11 of the plug P are contacted with the first ring spring contact piece 5, second ring spring contact piece 6, and sleeve spring contact piece 7 of the jack J, respectively. As a result, a video signal, an audio signal, or the like can be transmitted and received.

As shown in FIG. 1, the jack J has a switch mechanism SW of the single-butt contact type which is configured by a stationary contact piece 12, a movable contact piece 13, and a separator 14 formed by an insulator.

Figure 2B:
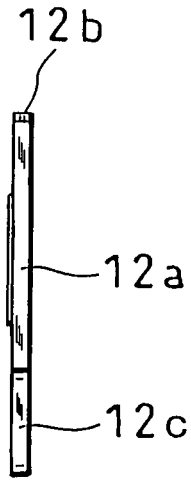
FIG. 2B is a side view of FIG. 2A.
Figure 2A:
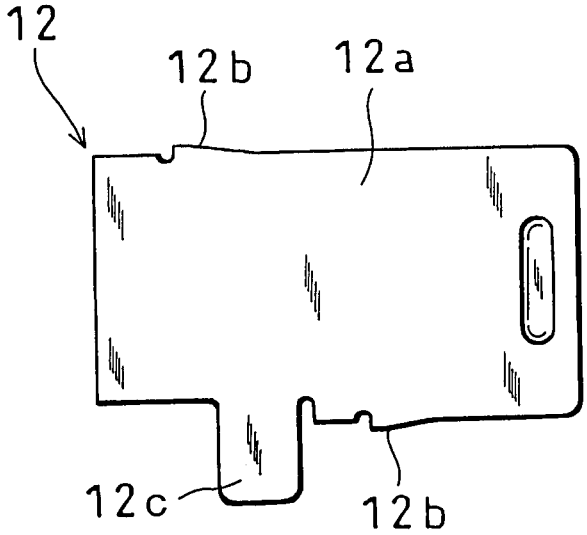
FIG. 2A is a rear (external face) view showing a stationary contact piece of a switch mechanism disposed in the jack of FIG. 1.

FIGS. 2A and 2B show the stationary contact piece 12. FIG. 2A is a rear (external face) view, and FIG. 2B is a side view of FIG. 2A. The stationary contact piece 12 is produced by punching a thin metal plate having no spring characteristics. A rectangular flat plate-like contact piece body 12*a*, an arrow-headed locking projection 12*b* which is a projection that is projected flushly with a side edge of the contact piece body 12*a*, and a soldering leg portion 12*c* which is to be connected to a circuit board (not shown) are integrally disposed. In this way, the stationary contact piece 12 is not required to be displaced unlike the movable contact piece 13 which will be described later. Therefore, an inexpensive conductive material having no spring characteristics, such as a thin metal plate can be used as the material, and the stationary contact piece can be easily produced by performing only a punching process, so that the stationary contact piece can be obtained very economically as compared with the movable contact piece 13 which will be described later.

Figure 3B:
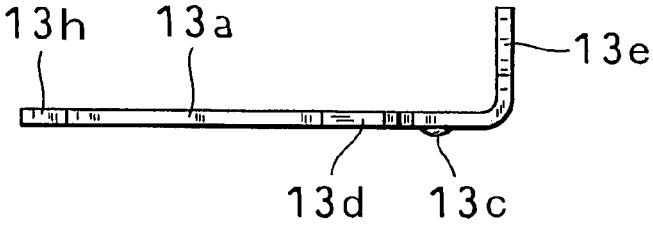
FIG. 3B is a top view of FIG. 3A.
Figure 3A:
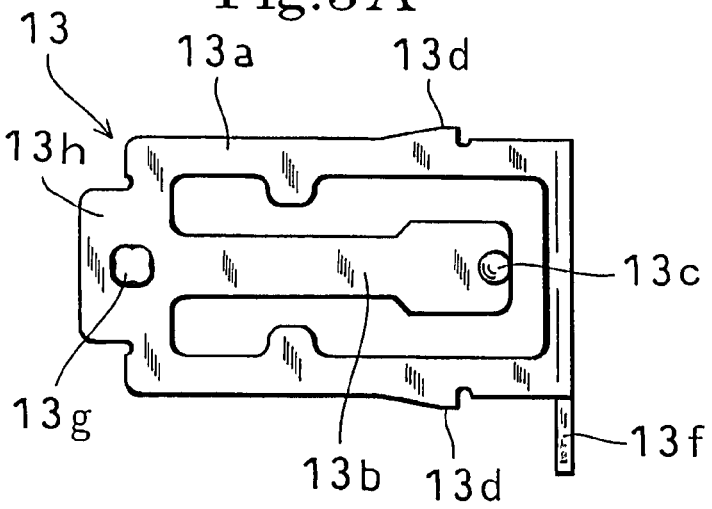
FIG. 3A is a rear view showing a movable contact piece of the switch mechanism disposed in the jack of FIG. 1.
Figure 3C:
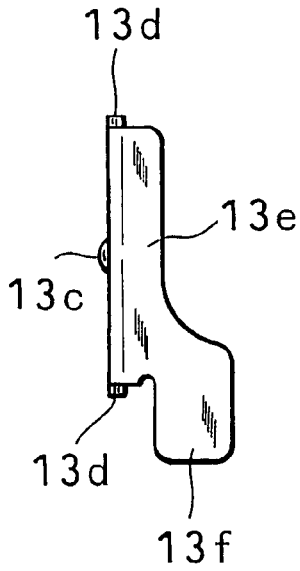
FIG. 3C is a side view of FIG. 3A.

FIGS. 3A to 3C show the movable contact piece 13. FIG. 3A is a rear view, FIG. 3B is a top view of FIG. 3A, and FIG. 3C is a side view of FIG. 3A. The movable contact piece 13 is required to be displaced, and hence produced by punching and bending a conductive material, or a thin metal plate having spring characteristics. In the movable contact piece, the following components are integrally disposed: a rectangular flat frame portion 13*a* which is approximately identical in external shape and size with the contact piece body 12*a* of the stationary contact piece 12; a spring portion 13*b* which is a plate spring serving as a cantilevered (cantilever) rectangular flat plate-like contact piece body that, inside the frame portion 13*a*, extends flushly with the frame portion 13*a* from a middle portion of an inner edge of a short side of the frame portion 13*a* to the front of an inner edge of the other short side; a contact portion 13*c* which is projected from a tip end portion of the spring portion 13*b* toward the rear face side; a locking projection 13*d* which is a projection that is projected flushly with an outer edge of the frame portion 13*a;* an end piece portion 13*e* which is perpendicularly bent and raised to the surface side of the frame portion 13*a* along an outer edge of the short side of the frame portion 13*a* that is on the side of the tip end of the spring portion 13*b*; a soldering leg portion 13*f* which is to be connected to the circuit board (not shown), and which is projected flushly with the end piece portion 13*e* toward the outside of the frame portion 13*a*; a through hole 13*g* which is opened in the middle of the short side of the frame portion 13*a* that is on the side of the basal end of the spring portion 13*b*; and a projection piece portion 13*h* which is projected flushly with a middle portion of the short side of the frame portion 13*a* that is on the side of the basal end of the spring portion 13*b*.

Figure 4B:
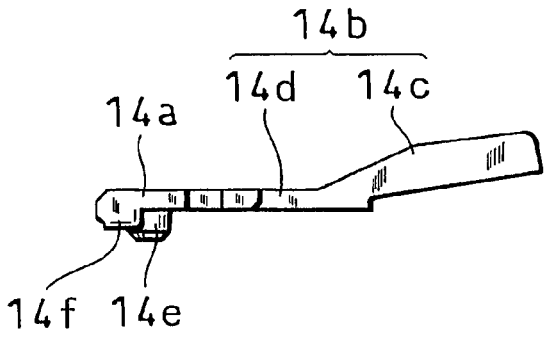
FIG. 4B is a top view of FIG. 4A.
Figure 4C:
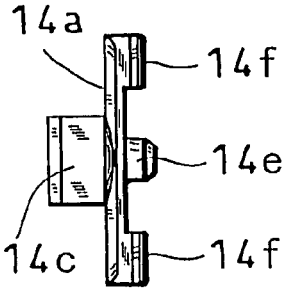
FIG. 4C is a side view of FIG. 4A.
Figure 4A:
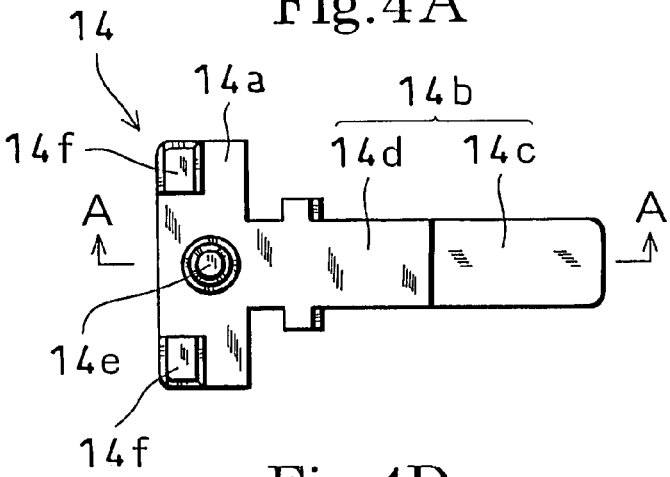
FIG. 4A is a rear view showing a separator of the switch mechanism disposed in the jack of FIG. 1.
Figure 4D:
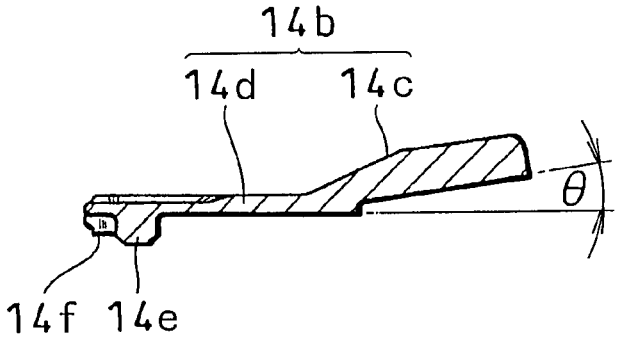
FIG. 4D is a section view taken along the line A-A of FIG. 4A.

FIGS. 4A to 4D show the separator 14. FIG. 4A is a rear view, FIG. 4B is a top view of FIG. 4A, FIG. 4C is a side view of FIG. 4A, and FIG. 4D is a section view taken along the line A-A of FIG. 4A. The separator 14 is molded by a hard resin such as a polyamide resin, and formed into a T-like shape by: a stationary piece portion 14*a* which corresponds to the short side of the frame portion 13*a* that is on the side of the basal end of the spring portion 13*b* of the movable contact piece 13; and a movable piece portion 14*b* which perpendicularly extends from a middle portion of one side edge of the stationary piece portion 14*a*, and which corresponds to the spring portion 13*b* of the movable contact piece 13. The movable piece portion 14*b* is bent into an L-like shape along the length direction so that the tip end side with respect to a middle portion in the length direction is bent and raised to the surface side. A pressed portion 14*c* which is inclined so as to be progressively raised from the middle bent portion toward the tip end side is formed. A spring portion 14*d* which is flush with the stationary piece portion 14*a* is formed from the middle bent portion toward the basal end, as a coupling portion through which the pressed portion 14*c* is coupled to the stationary piece portion 14*a* so as to be displaceable in the thickness direction. A middle projection 14*e* which is to be fitted into the through hole 13*g* of the movable contact piece 13 is integrally formed on the middle of the rear face of the stationary piece portion 14*a*. Side projections 14*f* which sandwich the projection piece portion 13*h* of the movable contact piece 13 are integrally disposed on the both sides of the projection 14*e*.

As shown in FIG. 1, on the inner face (peripheral wall face of the plug insertion hole 2) of the body 1, the stationary contact piece 12 and the movable contact piece 13 are incorporated into the body 1 while being inserted into and engaged with a switch contact piece insertion groove 15 which is recessed on the inner side of the sleeve spring contact piece 7 and at a position opposed to the spring contact piece 4, and opposed to each other in the outside of the plug insertion hole 2 in a direction perpendicular to the plug insertion direction so that the contact pieces are not contacted with the plug P when the plug P is inserted. The stationary contact piece 12 and the movable contact piece 13 are opposed to each other in the switch contact piece insertion groove 15 in the direction perpendicular to the insertion/extraction direction of the plug P so that the stationary contact piece 12 is incorporated into the body 1 while being inserted into and engaged with a bottom portion of the switch contact piece insertion groove 15, the movable contact piece 13 is incorporated into the body 1 while being inserted and engaged with an opening side of the switch contact piece insertion groove 15 on the side of the plug insertion hole 2, the stationary contact piece 12 is placed outside, and the movable contact piece 13 is placed inside. The stationary contact piece 12 and the movable contact piece 13 are opposed to each other in the switch contact piece insertion groove 15 in the direction perpendicular to the insertion/extraction direction of the plug P so that one surface of the stationary contact piece 12 is separated from and opposed to the rear face of the movable contact piece 13 (in parallel to the insertion/extraction direction of the plug P) while maintaining a predetermined distance. The stationary contact piece 12 is incorporated into the body 1 in a state where, in the bottom portion of the switch contact piece insertion groove 15, the whole rear face of the contact piece body 12*a* is in close contact with a resin wall (insulation wall) 15*a* which forms the bottom face of the switch contact piece insertion groove 15. The movable contact piece 13 is placed so that the short side of the frame portion 13*a* which is on the side of the basal end of the spring portion 13*b* is positioned on the side of the plug insertion port 3, and the spring portion 13*b* extends from the middle portion of the inner edge of the side of the movable contact piece in the insertion direction of the plug P. The movable contact piece 13 is incorporated into the body 1 on the side of the opening of the switch contact piece insertion groove 15 so that the outer peripheral edge of the frame portion 13*a* is fixed to the resin wall (insulation wall) which forms the peripheral wall of the switch contact piece insertion groove 15, and the spring portion 13*b* is displaced in the switch contact piece insertion groove 15 in the thickness direction (the direction perpendicular to the insertion direction of the plug P) to allow the contact portion 13*c* to be contacted with and separated from the surface of the contact piece body 12*a* of the stationary contact piece 12. When the stationary contact piece 12 is incorporated into the body 1, the leg portion 12*c* is projected from the switch contact piece insertion groove 15 to the bottom face of the body 1. When the movable contact piece 13 is incorporated into the body 1, the end piece portion 13*e* is exposed so as to butt against an end face of the body 1 in the periphery of the opening of the end face of the body 1 which is opposite to the plug insertion port 3, and the leg portion 13*f* is projected from the bottom face of the body 1.

As shown in FIG. 1, the separator 14 is placed in an opening portion of the switch contact piece insertion groove 15 while being attached to the surface side of the movable contact piece 13 facing the plug insertion hole 2. In the separator 14, the side projections 14*f* sandwich the projection piece portion 13*h* of the movable contact piece 13 while the middle projection 14*e* is fitted from the surface side of the movable contact piece 13 into the through hole 13*g*, and the stationary piece portion 14*a* is coupled and fixed in a state where the stationary piece portion overlaps with the surface of the short side of the frame portion 13*a* which is on the side of the basal end of the spring portion 13*b* of the movable contact piece 13, whereby the movable piece portion 14*b* is placed so as to be opposed to the surface side of the spring portion 13*b* of the movable contact piece 13. The separator 14 is placed so that, in a similar manner as the spring portion 13*b* of the movable contact piece 13, the stationary piece portion 14*a* which is on the side of the basal end of the movable piece portion 14*b* is positioned on the side of the plug insertion port 3, and the movable piece portion 14*b* extends from a middle portion of one side edge of the stationary piece portion 14*a* in the insertion direction of the plug P. Since the movable piece portion 14*b* is bent into an L-like shape along the length direction, the rear face of the spring portion 14*d* which is flush with the stationary piece portion 14*a* that is on the side of the basal end with respect to the middle bent portion of the movable piece portion 14*b* butts against the surface which is on the side of the basal end with respect to the middle bent portion of the spring portion 13*b* of the movable contact piece 13, and the separator 14 is placed outside the plug insertion hole 2 so that, when the plug P is inserted, the stationary piece portion 14*a* and the spring portion 14*d* of the movable piece portion 14*b* are not contacted with the plug P. By contrast, the pressed portion 14*c* which is inclinedly bent and raised, and which is on the side of the tip end with respect to the middle bent portion of the movable piece portion 14*b* is raised from the spring portion 13*b* of the movable contact piece 13 so that the gap between the pressed portion and the spring portion 13*b* of the movable contact piece 13 is progressively expanded as advancing in the plug insertion direction, and the separator 14 is projected into the plug insertion hole 2 while progressively increasing the projection amount as advancing in the plug insertion direction. The separator 14 is mounted by attaching the separator to the movable contact piece 13 after the piece is incorporated into the body 1. Alternatively, the separator may be attached to the movable contact piece 13 before the piece is incorporated into the body 1, and the movable contact piece 13 in the state where the separator 14 is attached to the piece may be incorporated and mounted to the body 1. The separator 14 may be molded as a component which is separate from the movable contact piece 13, or molded integrally with the movable contact piece 13 by insert molding.

When the plug P is not inserted into the jack J, as shown in FIG. 1, the thus configured switch mechanism SW is in a switch-OFF state where the spring portion 13*b* of the movable contact piece 13 is at the initial position which is inside the frame portion 13*a*, and in which the portion is flush with the frame portion 13*a*, so as not to be contacted with the stationary contact piece 12. At this time, in the separator 14, the pressed portion 14*c* is projected into the plug insertion hole 2 while progressively increasing the projection amount as advancing in the plug insertion direction.

Figure 5:
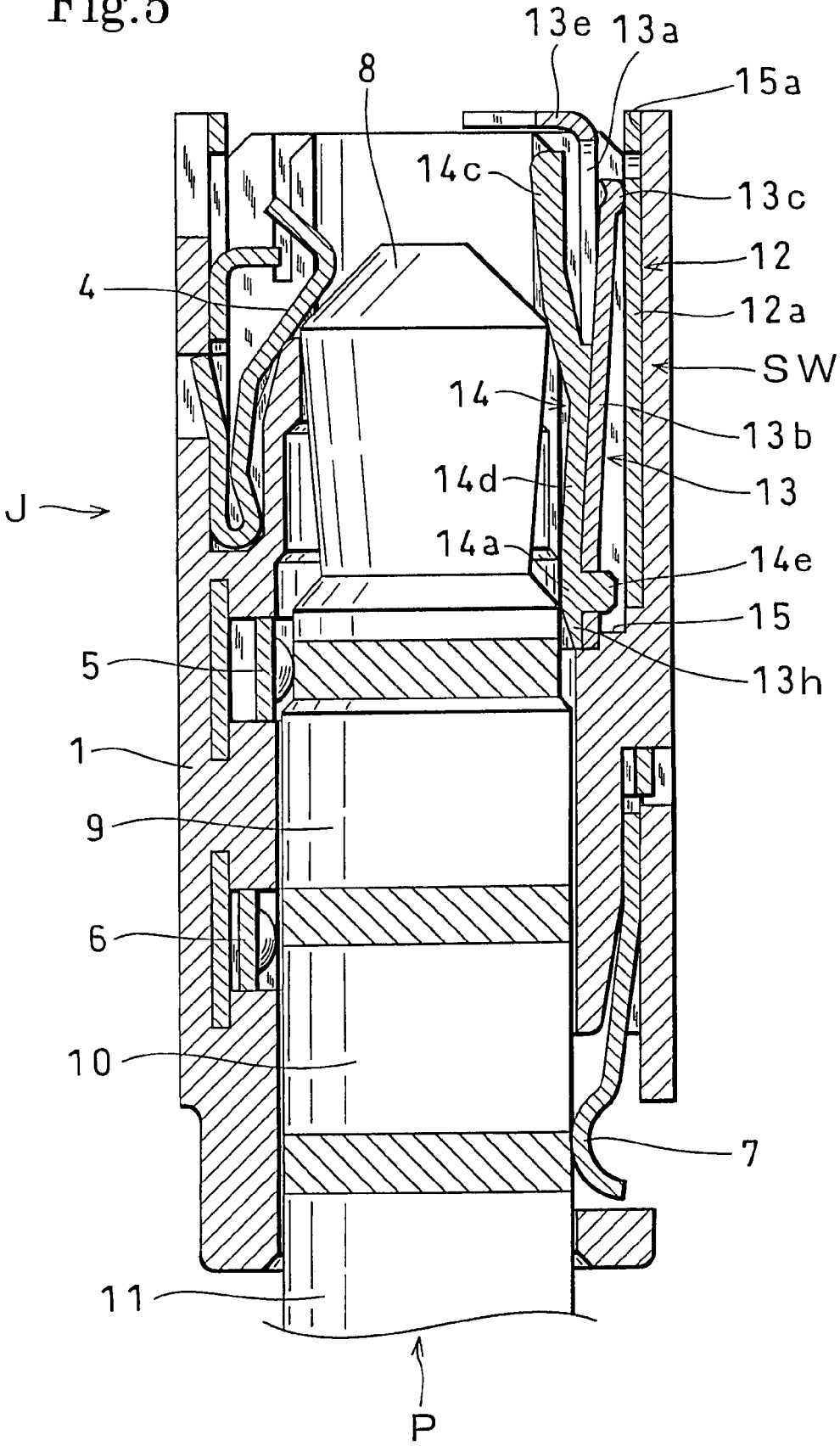
FIG. 5 is a section view of a plug jack in a state where a plug is inserted halfway into the jack of FIG. 1.

When the plug P is inserted from the plug insertion port 3 of the jack J into the plug insertion hole 2, as shown in FIG. 5, the pressed portion 14*c* of the separator 14 is outward pressed by the plug tip 8 of the plug P to be displaced to the outside with flexure of the spring portion 14*d*. At this time, in the separator 14, the middle bent portion of the movable piece portion 14*b* outward presses the middle portion in the length direction of the spring portion 13*b* of the movable contact piece 13, and applies a displacement load to the middle portion in the length direction of the spring portion 13*b* of the movable contact piece 13. In the movable contact piece 13, therefore, the spring portion 13*b* is flexed while setting the basal end portion thereof as a fulcrum, and the contact portion 13*c* at the tip end of the spring portion 13*b* is contacted with the stationary contact piece 12 (switch ON).

Thereafter, when the plug P is further inserted, as shown in FIG. 6, the pressed portion 14*c* of the separator 14 is further outward pressed by the plug tip 8 of the plug P to be displaced to the outside with flexure of the spring portion 14*d*. At this time, in the separator 14, the middle bent portion of the movable piece portion 14*b* further outward presses the middle portion in the length direction of the spring portion 13*b* of the movable contact piece 13, and applies a displacement load to the middle portion in the length direction of the spring portion 13*b* of the movable contact piece 13. Therefore, the movable contact piece 13 is flexed in the middle portion in the length direction while setting the contact portion 13*c* at the tip end of the spring portion 13*b* contacted with the stationary contact piece 12, as a fulcrum, and applies a contact pressure on the contact portion, so that the switch ON state with high contact reliability is attained.

Thereafter, as shown in FIG. 6, the plug P reaches the complete insertion position, and the pressed portion 14*c* of the separator 14 is outward pressed and held by the plug tip 8 of the plug P, whereby the switch ON state is held.

When the plug P is extracted away through the plug insertion port 3 from the plug insertion hole 2 of the jack J, the spring portion 13*b* of the movable contact piece 13 elastically returns to its initial position, and separates from the stationary contact piece 12, so that the state returns to the above-mentioned switch OFF state.

In the two contact pieces of the switch mechanism SW of the single-butt contact type which is disposed in the jack J, one contact piece is used as the movable contact piece 13, and the other contact piece is used as the stationary contact piece 12, so that the switching function which is identical with that of the conventional art can be performed. Therefore, the switch mechanism can be incorporated into a small space, and the component cost of the switch mechanism can be reduced. As a result, miniaturization of the jack J, and reduction of the production cost can be realized.

In the above embodiment, an example of the preferred embodiment of the invention has been described. The invention is not restricted to it, and may be variously modified without departing from the spirit of the invention. For example, the invention can be applied also to a jack having any number of poles as far as it is a jack having a switch mechanism of the single-butt contact type.

What is claimed is:

1. A jack having a switch mechanism of a single-butt contact type comprising:

a body defining a plug insertion hole; and a switch mechanism situated on one side of said body, said switch mechanism comprising:

a stationary contact piece mounted to said body;

a movable contact piece mounted to said body and having a plate spring serving as a cantilevered beam with a basal end portion and a tip end portion, said contact pieces being located opposite to each other outside said plug insertion hole in a manner that, when a plug is inserted, said contact pieces are not contacted with the plug; and an insulator comprising a basal portion, a tip end portion, and a middle portion, wherein a pressed portion of said insulator, which extends from said middle portion toward the tip end portion, is spaced from the movable contact piece and extends into the plug insertion hole so as to form a gap between the pressed portion and the movable contact piece, and wherein a spring portion of insulator, which extends from the basal portion toward the middle portion, is in contact with the movable contact piece, whereby, when the plug is inserted into the plug insertion hole, said spring portion of the insulator is pressed by the plug and displaced such that a displacement load is applied by said insulator to a middle portion in a length direction of said movable contact piece to flex said movable contact piece while setting said basal end portion of said movable contact piece as a fulcrum, and wherein:

said tip end portion of said movable contact piece contacts said stationary contact piece, and thereafter said middle portion in the length direction of said movable contact piece is flexed while setting said tip end portion as a fulcrum, to apply a contact pressure on a contact.

2. A jack according to claim 1, wherein:

said insulator is bent at a position corresponding to said middle portion in the length direction of said movable contact piece, one side with respect to said bent portion overlaps with said basal end side with respect to said middle portion in the length direction of said movable contact piece, an end portion of said one side is coupled to said basal end portion of said movable contact piece, and another side with respect to said bent portion is inclinedly raised with respect to a tip end side with respect to said middle portion in the length direction of said movable contact piece so as to project into said plug insertion hole while progressively increasing a projection amount while advancing in a direction of insertion of the plug; and said middle portion in the length direction of said movable contact piece is pressed by said bent portion.

3. A jack according to claim 1, wherein:

said insulator is pressed and displaced by a plug tip disposed in the tip end of the plug.

4. A jack according to claim 1, further comprising:

a spring contact piece situated in the vicinity of said plug insertion hole.

* * * * *